US006517423B2

(12) United States Patent
Ueno

(10) Patent No.: US 6,517,423 B2
(45) Date of Patent: Feb. 11, 2003

(54) POLISHING DEVICE

(75) Inventor: Makoto Ueno, Tagajo (JP)

(73) Assignee: Tateo Uegaki, Miyagi (JP)

( * ) Notice: Subject to any disclaimer, the term of this patent is extended or adjusted under 35 U.S.C. 154(b) by 0 days.

(21) Appl. No.: 10/088,324

(22) PCT Filed: Jul. 13, 2001

(86) PCT No.: PCT/JP01/06091

§ 371 (c)(1),
(2), (4) Date: Mar. 12, 2002

(87) PCT Pub. No.: WO02/06010

PCT Pub. Date: Jan. 24, 2002

(65) Prior Publication Data

US 2002/0182993 A1 Dec. 5, 2002

(30) Foreign Application Priority Data

Jul. 13, 2000 (JP) ..... 2000-213527

(51) Int. Cl.[7] ..... B24B 23/00
(52) U.S. Cl. ..... 451/359; 451/490; 451/508
(58) Field of Search ..... 451/353, 359, 451/490, 508, 526, 527, 529, 533

(56) References Cited

U.S. PATENT DOCUMENTS 4,490,948 A 1/1985 Hanstein et al.
4,920,702 A * 5/1990 Kloss et al.

FOREIGN PATENT DOCUMENTS

JP 02-48159 2/1990
JP 07-308862 * 11/1995
JP 2001-219379 8/2001

* cited by examiner

*Primary Examiner*—Eileen P. Morgan
(74) *Attorney, Agent, or Firm*—Knobbe, Martens, Olson & Bear LLP

(57) ABSTRACT

To provide a polishing tool with which a coating surface can be polished smoothly with easy operation, the polishing tool includes a base member drivingly rotated by a drive unit and having a mounting surface perpendicular to its rotary axis, an elastic member to be mounted on the base member and a polishing member to be mounted on the elastic member. The elastic member has groove portions opened toward the polishing member side and extending from a center of the elastic member toward a circumferential edge thereof. The opening edges of the groove portions are linear from the center of the elastic member to the circumferential edge thereof.

8 Claims, 13 Drawing Sheets

POLISHING DEVICE

This application is the U.S. National Phase under 35 U.S.C. §371 of International Application PCT/JP01/06091, filed Jul. 13, 2001, which claims priority to Japanese Patent Application No. 2000-213527, filed Jul. 13, 2000. The International Application was not published under PCT Article 21(2) in English.

TECHNICAL FIELD

The present invention relates to a polishing tool for polishing a coating surface into a predetermined shape.

BACKGROUND ART

There are various methods and kinds of polishing. A polishing work for a coating surface of a vehicle body such as an automotive vehicle, which requires a particularly high technique among those, will now be described.

In most general, the repair of the coating surface of a vehicle body such as an automotive vehicle is performed in accordance with the steps of peeling an old coating layer, feeding putty, grinding, masking, primary surface coating, cleaning and degreasing and surface coating as a final step in the stated order. In this surface coating step, after a final paint has been sprayed with a spray gun, "gradation" coating for eliminating a border between a portion on which the paint is coated and the portion on which no fresh paint is coated is performed, and finally, "coating polishing" generally called polishing (hereinafter referred to as polishing) is performed.

The polishing work is a work for polishing and removing the uppermost layer portion of the coating layer by a polishing member coated with a polishing agent to obtain a condition where the thin oily layer is left on the coating surface (generally called a wet glossy condition). The polishing agent is generally called a compound (hereinafter referred to as compound) and is in general the material that is mixed with a synthetic resin, if necessary or for use, adding plasticizer, fillant, coloring agent, stabilizer, reinforcer and any other various ingredient and that may be used for molding in this condition. In the compound used in polishing an automotive vehicle or the like, particles of silicon oxide, fossil particles such as diatomaceous earth or particles of alumina or the like are mixed into a lubricant.

The work for polishing the coating surface smoothly with a manual polishing tool requires a rather large labor. Therefore, in order to reduce the labor, a mechanical polishing device (generally called a polisher and hereinafter referred to as a polisher) utilizing compressed air or electric power as a power source is used. This polisher is composed of a base member rotated and driven by a drive unit and having a mounting surface perpendicular to its rotary shaft and a polishing member mounted on the mounting surface for polishing the coating surface.

However, the polishing member used in this polishing tool suffers from a problem. In the polishing member designed for grinding rather than polishing (glossing), the polishing member per se is made relatively hard material or a polishing surface roughness of the polishing member is increased to enhance the cutting force. As a result, in any case, a remarkable damage or shade is left after polishing. Also, the polishing member designed for polishing (glossing) suffers a problem in that the polishing (grinding) force is deteriorated because the polishing member per se is made of relatively soft material or the coating surface roughness is made fine. A goodness of the polishing (grinding) characteristics depends upon the characteristics of roughness, hardness or the like of the particles of the compound so that the alliance with the polishing member is impossible and the polishing member is remarkably exhausted.

As shown in FIGS. 19, 20 and 21 as a polishing tool for solving this problem, it is therefore possible to propose a polishing tool 101 in which an elastic member 108 is interposed between a base member 106 and a polishing member 111. A plurality of holes 100 are provided along a circumferential edge of this elastic member 108. The polishing work for the coating surface is performed by a polisher 118 provided with this polishing tool 101.

Then, the plurality of holes 100 are provided in the elastic member 108 so that the pressure of ground contact with convex portions scattered on the coating surface when the polishing member 111 is brought into contact with the coating surface is increased. Namely, the contact area where the polishing member 111 is brought into contact with the coating surface is decreased but the pressure is concentrated on the arcuate portion forming the holes 100 to increase the pressure of ground contact. For this reason, it is possible to finish the coating surface in which both grinding and glossing functions are sufficiently exhibited.

Thus, it is possible to easily obtain the desired flat and finished polished surface without any high technical skill. In addition, the above-described theory in which the pressure of ground contact is increased, is a reasonable method for obtaining the flat polished surface. Accordingly, it is possible to obtain a desired polished surface for a necessary minimum period of time.

However, the holes 100 are provided on the circumferential edge of the elastic member 108 of the polishing tool 101 so that the ground contact area on the circumferential edge is considerably decreased in comparison with the ground contact area of the central portion. For this reason, there is nonuniformity in the coating surface. In order to avoid this, the operator must suitably operate the polishing tool 101 to the coating surface. Actually, a high technical skill is required for this.

Also, a centrifugal force is generated since the polishing tool 101 is operated at a high torque and at a high speed. Then, when the polishing tool 101 in operation is brought into contact with the static coating surface, the phenomenon called a bound in which the coating surface and the polishing tool 101 are repulsive to each other due to the centrifugal force is caused. This becomes a fatal damage in the polishing step that requires a uniform polishing work.

In view of the foregoing defects, an object of the present invention is therefore to provide a polishing tool with which a coating surface can be polished smoothly with an easy operation. Then, it is another object of the invention is to provide a polishing tool which can avoid a bound phenomenon. Also, it is still another object of the invention is to provide a polishing tool which can polish a coating surface smooth and glossy for a short period of time.

DISCLOSURE OF THE INVENTION

According to the present invention, a polishing tool includes a base member drivingly rotated by a drive unit and having a mounting surface perpendicular to its rotary axis, an elastic member to be mounted on the base member and a polishing member to be mounted on the elastic member, in which the elastic member has groove portions opened toward the polishing member side and extending from a center of the elastic member toward a direction of a circumferential edge thereof, and the opening edges of the grooves portions are linear from the center of the elastic member to the circumferential edge thereof.

Since the opening edges of the groove portions have linear portions, it is possible to perform polishing in a two-stage manner of linear portions and area portions. This means that first of all grinding (cutting) is effected with the linear portions to convex portions of the coating surface and thereafter glossing is effected with the area portions.

The polishing tool according to the present invention is composed of the above-described necessary elements but the invention may be established even if its structure may be the one described below in detail. The specific structural element is characterized in that the groove portions are provided to extend from the center to the circumferential edge of the elastic member. With this structure, the contact areas at the center and the circumferential edge are substantially the same each other to thereby make it possible to hardly create the non-uniformity in the polishing surface.

Incidentally, according to the present invention, it is preferable that the groove portions be radially provided from the center of the elastic member. With this structure, since the polishing member is uniformly bend along the grooves when the surface such as an edge portion, a corner portion or the like which has the concave and convex portions is to be polished, it is possible for the operator to easily perform the polishing work of the convex and concave surfaces without mastering a high technical skill like suitably adjusting the depression force every time.

Furthermore, the groove portions provided in the elastic member are formed so that their width is increased toward the circumferential edge. Moreover, the circumferential edge of the base member is formed to be movable. Accordingly, since the circumferential edge is well movable to the convex and concave portions, it is possible to polish more precisely an edge portion or a corner portion or the like that is difficult to be polished.

Also, the base member according to the present invention is characterized in that its elasticity is enhanced from the center toward the circumferential edge thereof. If the high elasticity is ensured in the circumferential edge of the base member, the movability of the circumferential edge is enhanced as described above and the polishing at the portion where the polishing has been difficult conventionally may readily be performed. According to this invention, in order to ensure the elasticity at the circumferential edge, the elastic material is used for the material of the surface plate portion and the thickness of the surface plate portion is defined so as to be decreased from the center to the circumferential edge thereof.

Furthermore, the polishing member is characterized in that it is formed of a material softer than that of the elastic member. Note that according to the present invention, it is preferable that the polishing member is made of soft sponge, wool or cloth material and the elastic member is made of hard elastic material.

Also, the polishing tool according to the present invention is characterized in that a shock moderating member is disposed between the base member and the elastic member. With this structure, the bound phenomenon that has been worried conventionally is absorbed by the shock moderating member so that the coating surface can be polished uniformly.

As described above, according to the present invention, it is possible to provide the polishing tool with which the coating surface can be polished smoothly with easy operation. Also, according to the present invention, the shock moderating member is clamped whereby it is possible to provide the polishing tool with which the bound phenomenon can be avoided. Also, the grinding (cutting) work is performed by line and the glossing work is performed by area, whereby it is possible to provide the polishing tool with which the coating surface can be polished smooth and glossy for a short period of time.

BEST MODE FOR CARRYING OUT THE INVENTION

Figure 1:
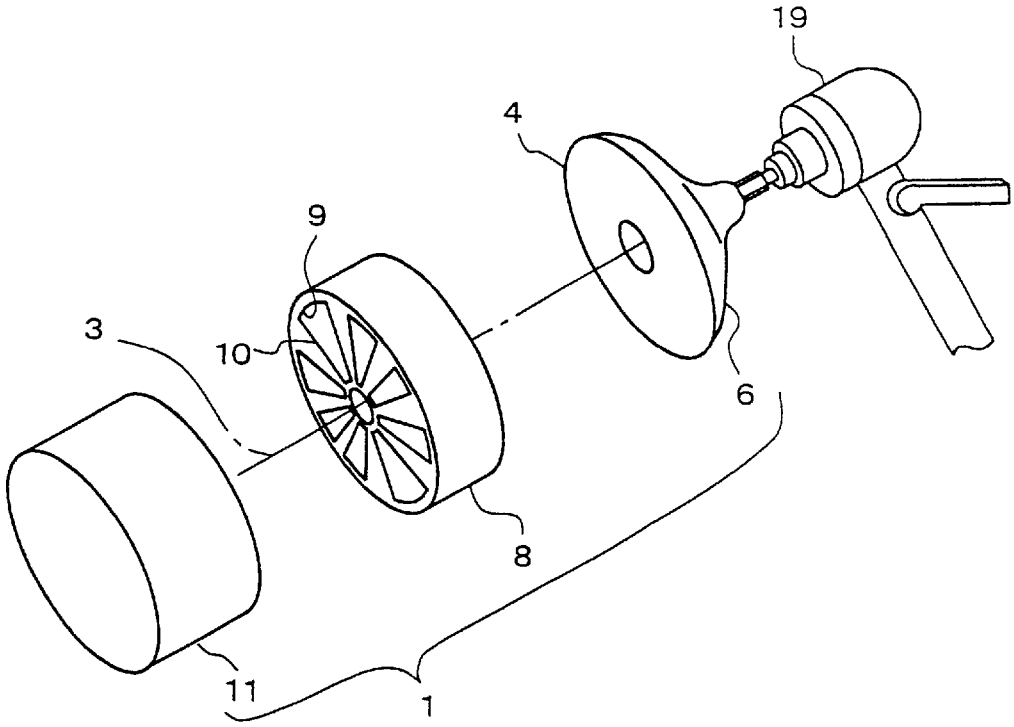
FIG. 1 is an exploded perspective view showing a polishing tool in accordance with an embodiment of the present invention.

The present invention will now be described in detail referring to the accompanying drawings.

Note that in an embodiment of the present invention, as coating repair steps for repairing a damage or a recess of a vehicle body, the steps of peeling an old coating layer, feeding putty, grinding a putty surface, masking, primary surface coating, cleaning and degreasing and overcoating are performed in this order.

First of all, the peeling step for the old coating layer is performed (not shown). In this step, first of all, the step for peeling a primer, a surfacer and a paint coated on a steel plate is performed. In almost all the cases, the old coating layer is removed in the case where the damage on the surface to be repaired is a recess. However, since the coating layer has already been removed in the case where the damage is a scratch or a linear damage, a judgement is made as to whether or not the old coating film is further removed depending upon the condition of the damage.

Subsequently, move on the putty feeding step. A somewhat large amount of putty material is filled in the recess in the surface to be repaired. Then, after the putty has been sufficiently dried and cured, the grinding step is performed using sandpaper from rough one to fine one (in this case, No. 60 to No. 80) in order until the putty filled surface where the putty material is filled is made flush with the body surface. Next move on the grinding step of the putty filled surface. In this step, the polishing step is performed so that the putty filled surface becomes smooth. This grinding step requires a high technical skill for the operator and is such an important work that it is safe to say that the result of this work determines the finished state of the final repair. Also, since this grinding step requires a rather large amount of labor, the grinding work is performed while using a mechanical grinding device using compressed air or electric power as a power source (hereinafter referred to as a sander). Incidentally, although omitted in the steps of the present embodiment, before the putty feeding step and after the damaged portion from which the old coating layer is removed and its periphery have been sufficiently cleaned and dried, if the degreasing work for scraping the oily component with a cloth into which a degreasing material such as a silicon-off or the like is sunk is performed, the contactability of the putty is enhanced.

Then, when the putty filled surface is made flush with the body surface, masking is performed such that the portion not to be coated is covered by a masking paper. Next move on the primary surface coating step. Then, the primer and the surfacer are sprayed onto the putty filled surface in this order by a spray gun (not shown). Then, after the surfacer has been sufficiently dried, the polishing step of the patty filled surface is performed. In this polishing work, in order to reduce the labor required for the polishing, a mechanical sander is used. As described above, with respect to this sander, pieces of sand paper from rough one to fine one (in this case No. 400 to No. 800) are used in order to perform the polishing step. Then, after the completion of polishing, as described above, the putty filled surface is cleaned, sufficiently dried, and degreased.

Then, the overcoating work is performed as soon as the putty filled surface has been fully dried and the degreasing work has been finished. In this step, the "gradation" coating work for eliminating the border between the portion where the paint is coated and the portion where no fresh paint is coated is performed after spraying the final paint by the spray gun as described above and finally, the polishing work is performed.

The polishing tool according to the present invention applied to a polishing device for performing polishing (hereinafter referred to as a polisher) will now be described in detail.

As shown in FIG. 1, the polishing tool 1 according to the present invention has a base member 6 drivingly rotated by a drive unit 19 and having a mounting surface 4 perpendicular to its rotary shaft, an elastic member 8 to be mounted on the base member 6 and a polishing member 11 to be mounted on its elastic member 8. Then, the elastic member 8 has groove portions 9 opened toward the polishing member 11 side and extending from the center of the elastic member 8 toward the direction of the circumferential edge thereof. The opening edges 10 of the groove portions 9 are formed into linear shapes extending from the center of the elastic member 8 toward the circumferential edge thereof.

Figure 2:
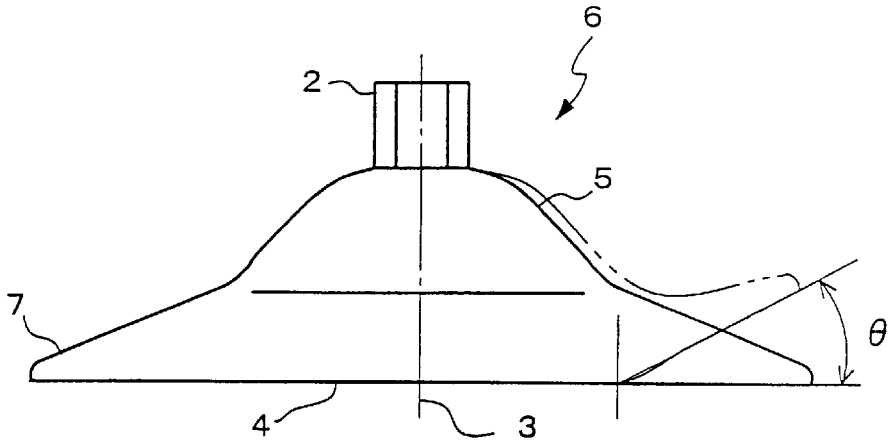
FIG. 2 is a frontal view of a base member in accordance with the embodiment of the present invention.
Figure 3:
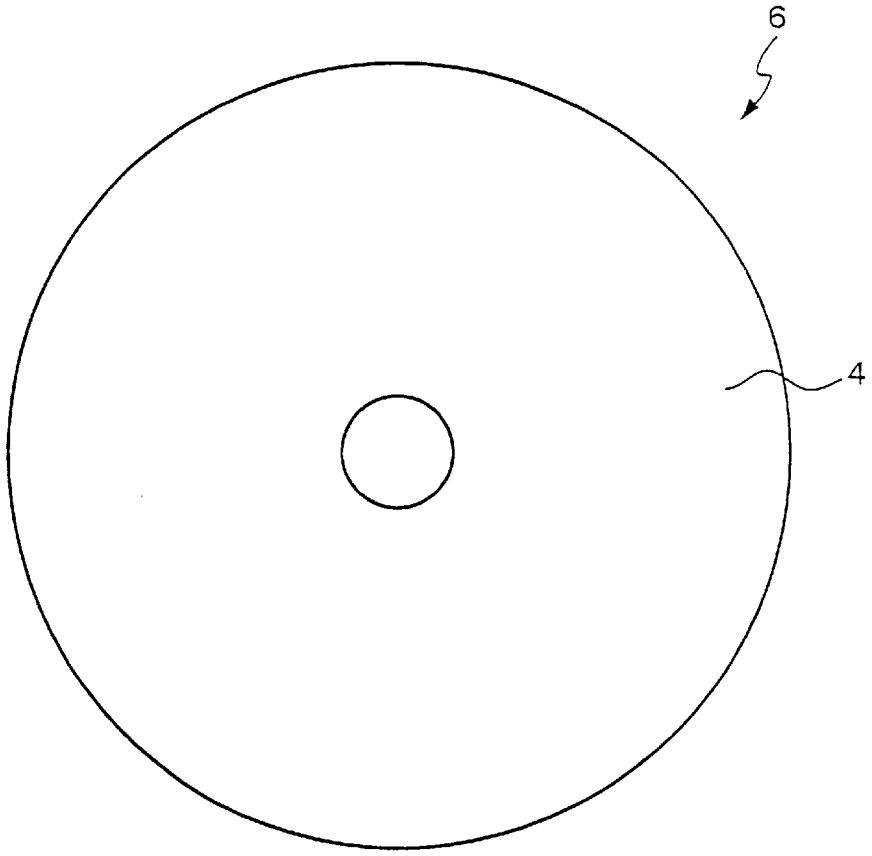
FIG. 3 is a bottom view of the base member in accordance with the embodiment of the present invention.

As shown in FIGS. 2 and 3, the base member 6 is formed by a screw portion 2 and a mounting surface 4 provided perpendicular to the screw portion 2 about the center of the screw portion 2 as a rotary axis 3.

The mounting surface 4 is disk-like shaped and formed by a convex portion 5 with its central portion extending toward the screw portion 2 and a circumferential edge portion 7 having a common center with the convex portion 5 and having a greater radius than that of the convex portion 5. This circumferential portion 7 is formed to be much thinner than the convex portion 5.

Figure 4:
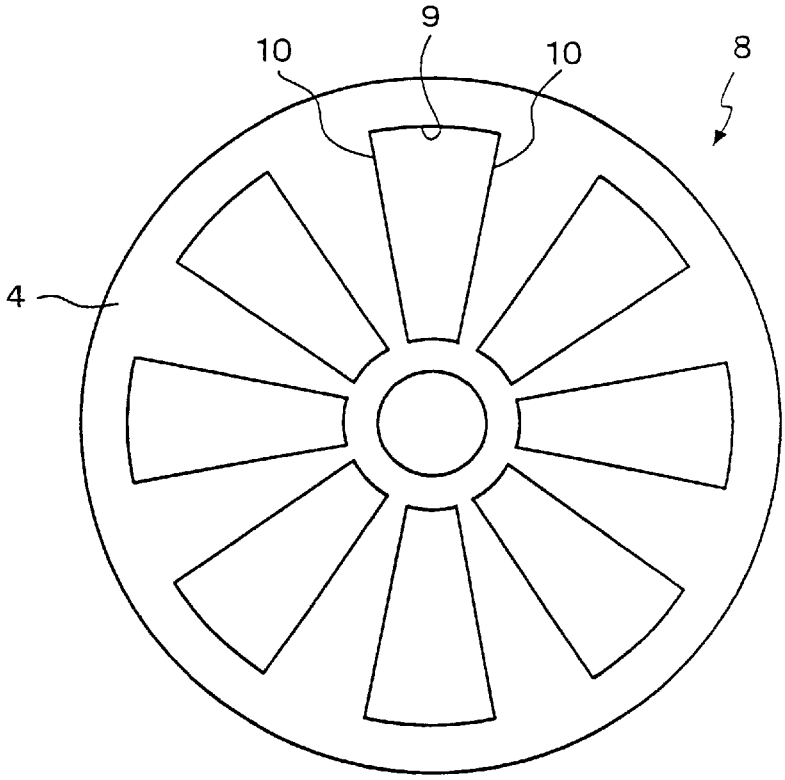
FIG. 4 is a plan view of an elastic member in accordance with the embodiment of the present invention.
Figure 5:
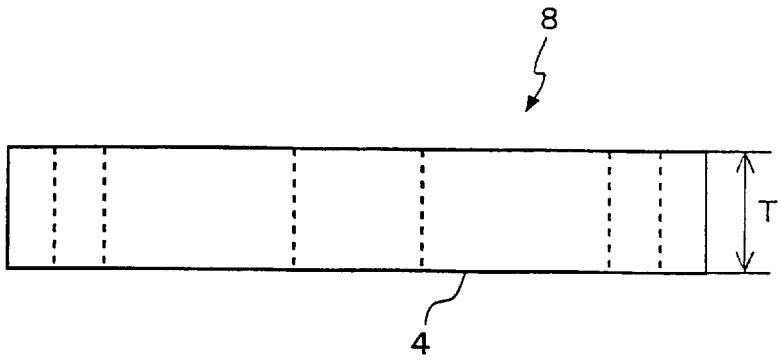
FIG. 5 is a side elevational view of the elastic member in accordance with the embodiment of the present invention.

Also, as shown in FIGS. 4 and 5, the elastic member 8 to be mounted on the mounting surface 4 is a disk-like shape congruent with the mounting surface 4 with its thickness T being set in the range of 15 mm to 25 mm. Furthermore, groove portions 9 extending from the central portion of the elastic member 8 to the direction of circumferential edge thereof are formed in the elastic member 8. Although, in this embodiment, the groove portions 9 are provided through the elastic member 8, it is sufficient to set the necessary condition that the groove portions are opened in the direction exactly opposite to the mounting surface 4 side (i.e., toward the polishing member 11 side). For example, even if the groove portions 9 have a depth that is half a thickness of the elastic member 8, it is sufficient that the groove portions have the opening portions toward the polishing member 11 side.

Also, the groove portions 9 have linear portions extending from the central portion of the elastic member 8 toward the circumferential edge in parts of the opening edges 10. Also, a width of the groove of each groove portion 9 is formed to be gradually expanded from the central portion of the elastic member 8 toward the circumferential edge thereof. Furthermore, it is preferable that the groove portions 9 are formed extending radially from the central portion of the elastic member 8. Incidentally, it is preferable that the elastic member 8 is made of hard elastic material such as hard sponge, hard rubber, elastic resin or the like.

Note that the result of each experiment of the elastic member conducted in accordance with a method stipulated JIS will be described below referring to Table 1.

TABLE 1

| Test items | Experimental results |
|---|---|
| Hardness test | Hardness Hs (SRIS C) 35 |
| Tension test | Specific weight 0.32 |
| Shearing test | Tension strength 10.8 kgf/cm$^2$ |
| | Elongation 150% |

TABLE 1-continued

| Test items | Experimental results |
|---|---|
| Repulsive elastic test | Repulsive elasticity 45% |
| Aging test | Hardness change +6Hs<br>Tension strength change rate −8.3%<br>Elongation change rate −13.7% |
| Compression permanent strain test | Compression permanent strain rate 0.9% |
| Compression test | 25% compression stress 1.17 kgf/cm$^2$<br>50% compression stress 2.24 kgf/cm$^2$ |
| Water absorption test | Water absorption amount 0.28 g/cm$^2$ |
| Oil-proof test | Volume change rate JIS No. 1 oil −4.0%<br>JIS No. 3 oil +1.0% |

Analyzing the experimental result, it will be understood that the elastic material is relatively hard material among the elastic materials and its elastic force is remarkable. Namely, even if the surface to be polished is metal like a body of a vehicle or the like, the material is suitable for cutting and polishing the surface.

Figure 6:
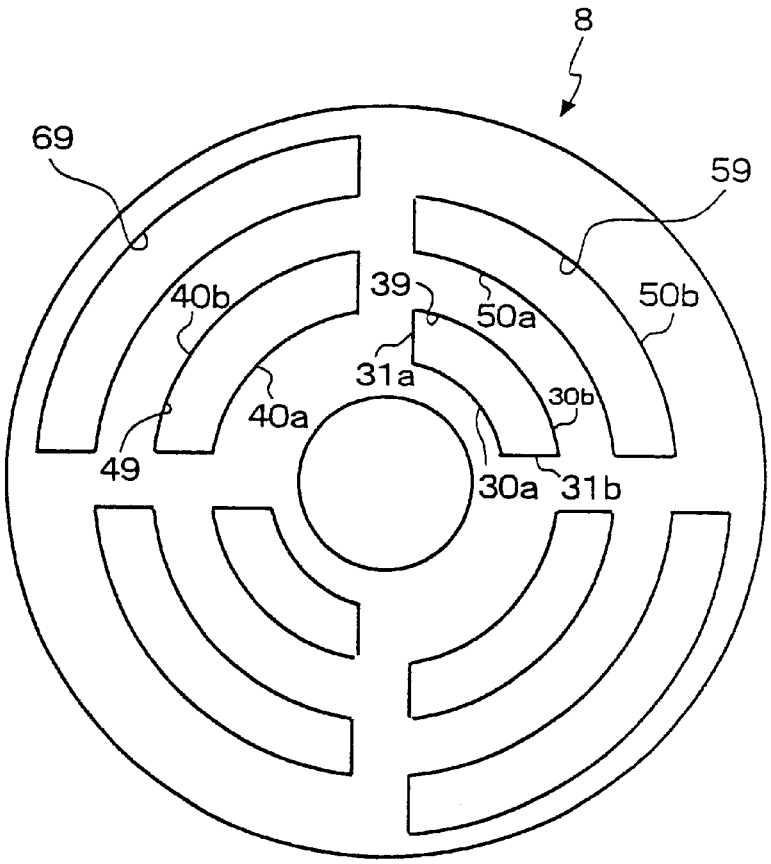
FIG. 6 is a plan view of an elastic member in accordance with another embodiment of the present invention.
Figure 7:
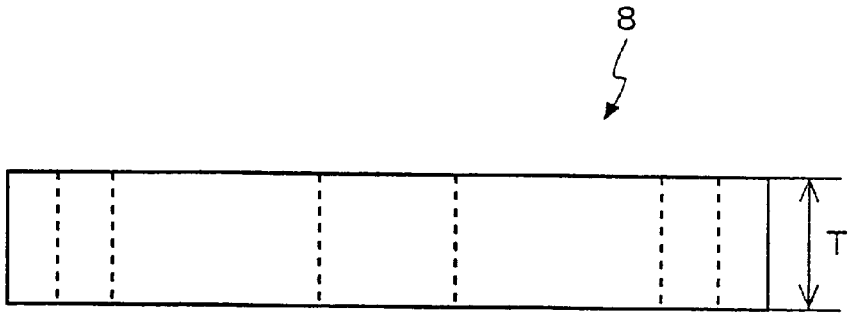
FIG. 7 is a side elevational view of the elastic member in accordance with another embodiment of the present invention.

Furthermore, in the embodiment, the groove portions 9 per se are formed extending from the central portion of the elastic member 8 toward the circumferential edge thereof. However, it is possible to provide groove portions as shown in FIGS. 6 and 7 as the groove portions of another embodiment. These groove portions are provided to face each other with respect to the center of the elastic member and arranged radially with a predetermined interval from the central portion of the elastic member. A shape of each groove portion is formed into a substantially sector shape defined by connecting by line components both end portions facing each other of two arcs having different radii with the same central angle about the center of the circles. Namely, explain in gone example of the groove portion 39, the groove portion 9 is formed into a substantially sector-shaped groove defined by connecting by line components 31*a* and 31*b* end portions facing each other of the arc 30*a* having a smaller radius and arc 30*b* having a larger radius than that of the arc 30*a* and positioned outside of the arc 30*a*.

Furthermore, these grooves are arranged in a staggered manner with respect to the adjacent ones. Namely, the smaller radius arc 40*a* for forming the groove portion 49 provided at a predetermined interval on the outside of the groove 39 is formed on the same circumference as that of the arc 30*b* for forming the groove portion 39. The smaller radius arc 50*a* for forming the groove portion 59 provided at a predetermined interval on the outside of the groove portion 49 is formed on the same circumference as that of the greater radius arc 40*b* for forming the groove portion 49. The groove portion 59 is formed by this arc 50*a* and an arc 50*b* provided at a predetermined interval on the outside of the arc 50*a*. In the same manner, the groove portion 69 is formed at a predetermined interval on the outside of the groove portion 59. Note that the thickness T is set in the range of 15 mm to 25 mm in the same way as in the elastic member 8 shown in FIGS. 4 and 5.

Figure 8:
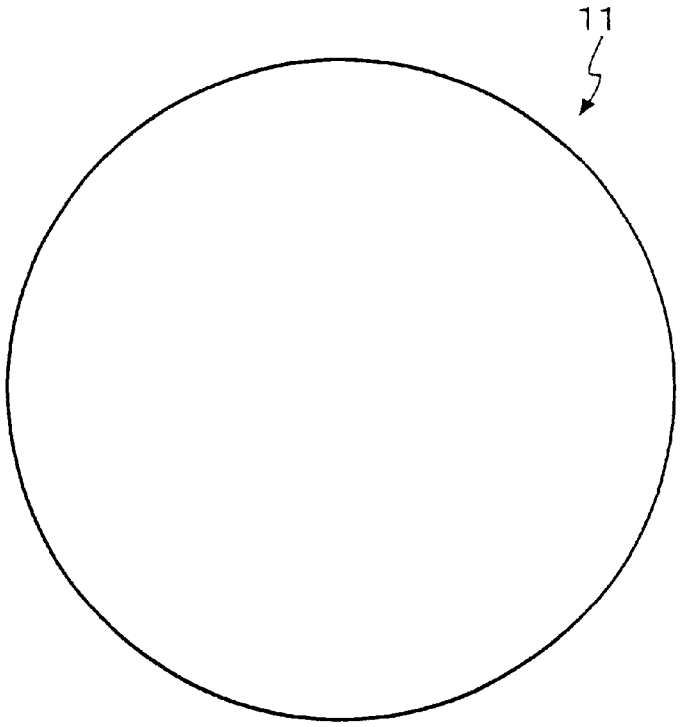
FIG. 8 is a plan view of a polishing member in accordance with the embodiment of the present invention.
Figure 9:
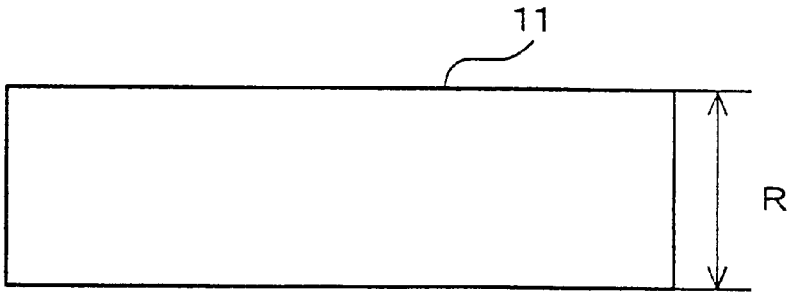
FIG. 9 is a side elevational view of the polishing member in accordance with the embodiment of the present invention.
Figure 10:
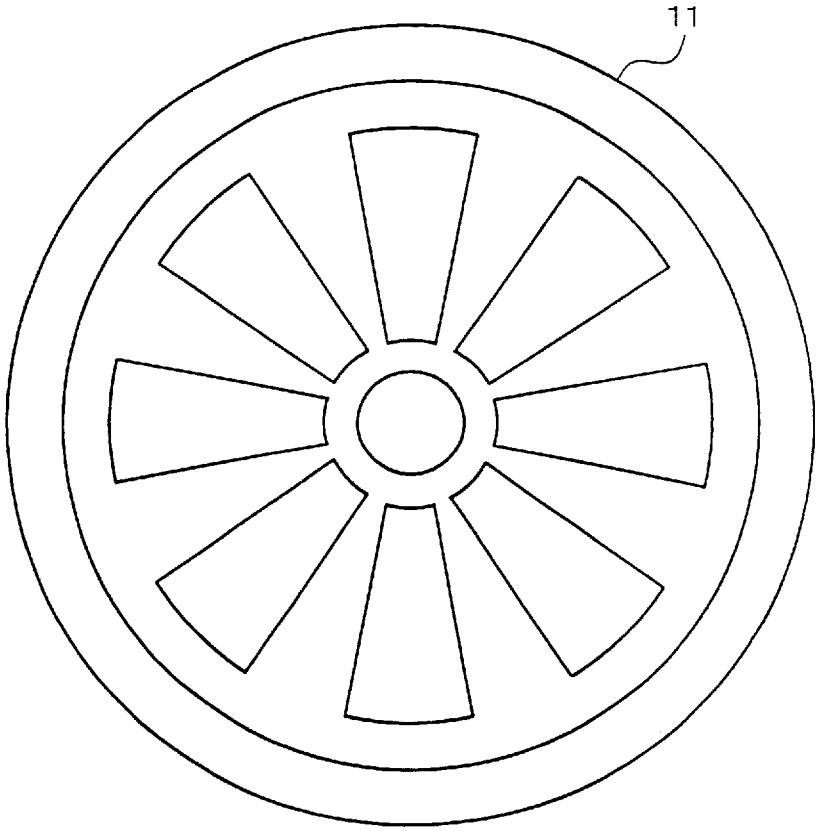
FIG. 10 is a plan view showing a modification of the elastic member in accordance with the embodiment of the present invention.
Figure 11:
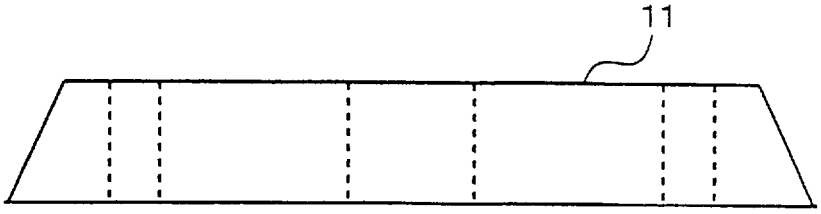
FIG. 11 is a side elevational view showing a modification of the elastic member in accordance with the embodiment of the present invention.
Figure 12:
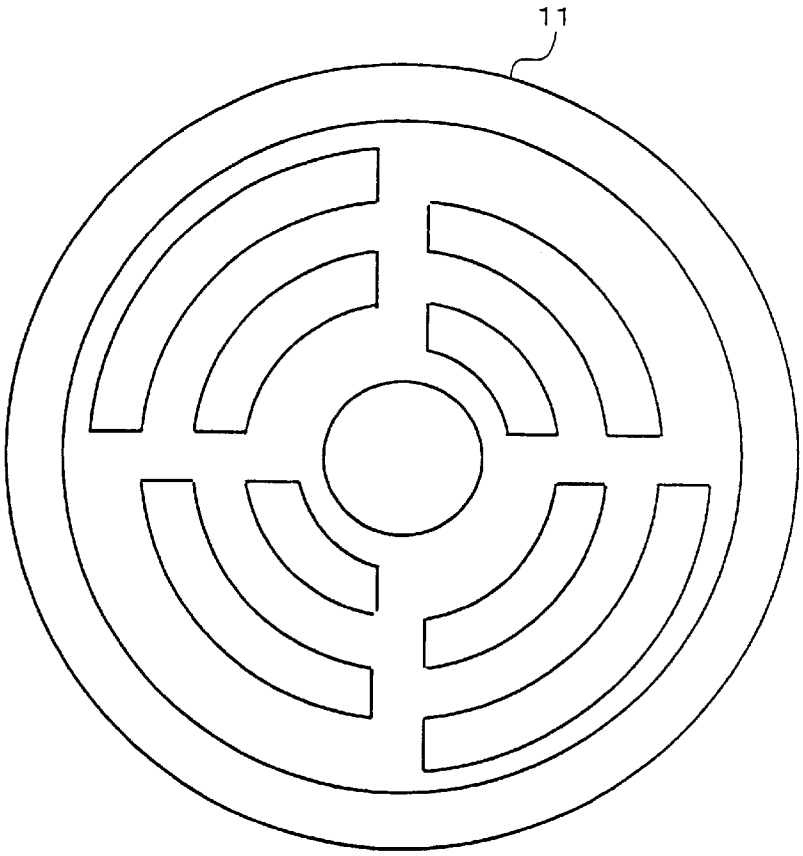
FIG. 12 is a plan view showing a modification of the elastic member in accordance with another embodiment of the present invention.
Figure 13:
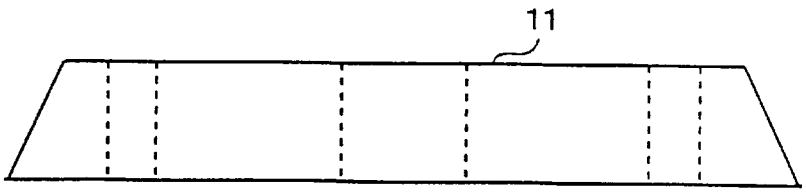
FIG. 13 is a side elevational view showing a modification of the elastic member in accordance with another embodiment of the present invention.

Furthermore, as shown in FIGS. 8 and 9, the polishing member 11 to be mounted on the side of the opening portion of the elastic member 8 is disk-like shaped to be congruent with the base member 6 as in the elastic member 8 with a thickness R being set in the range of 20 mm to 30 mm. The polishing member 11 is made of material having soft property and elastic property such as soft sponge, wool, cloth material or the like. It is preferable that the polishing member 11 is made of softer material than the elastic member 8.

Figure 16:
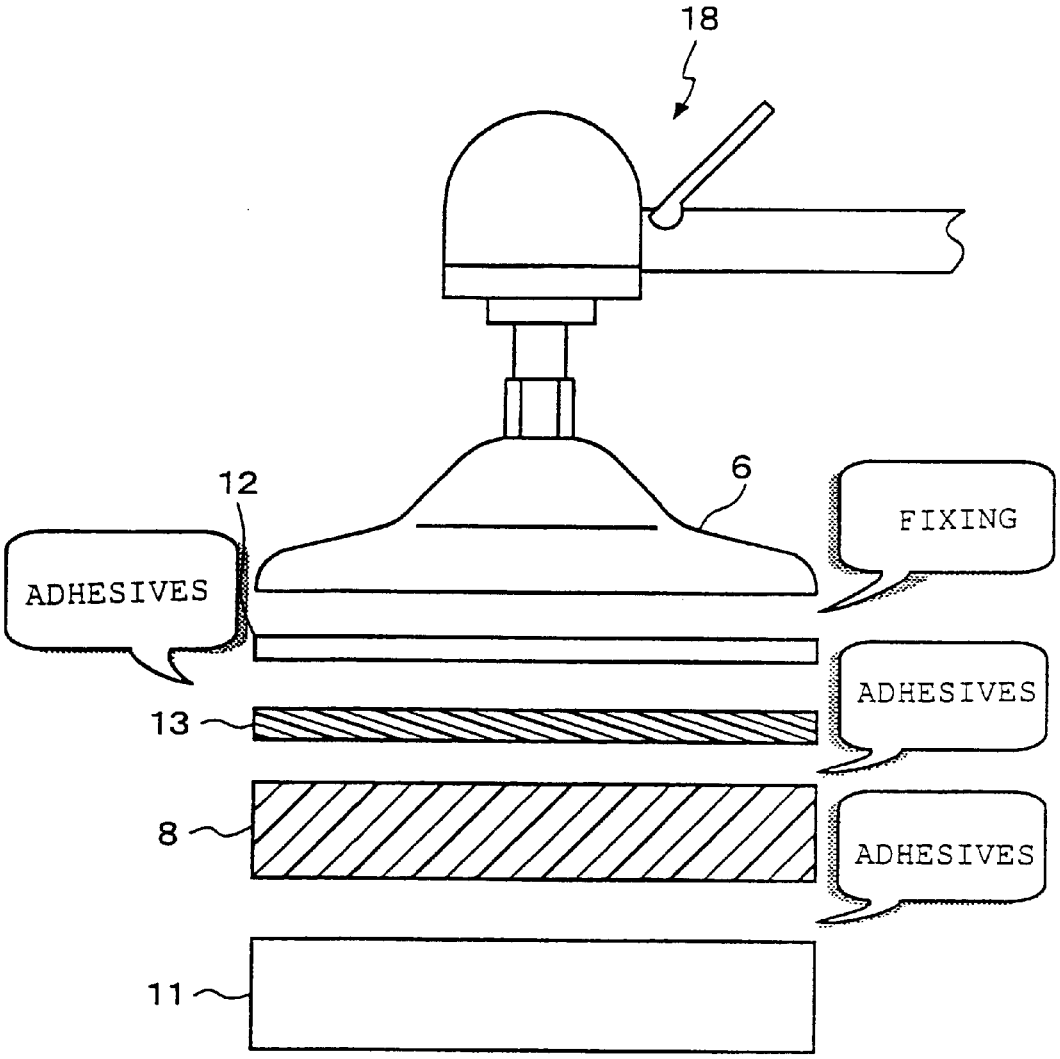
FIG. 16 is a side elevational view showing a mounting structure of the polishing tool in accordance with the embodiment of the present invention.

As shown in FIG. 16, these members are mounted by adhering the members with each other with adhesives, or by interposing a disk-like pad 12 with either surface of the top and the bottom being subjected to a magic type process therebetween.

Incidentally, in the case where the cloth material is used for the polishing member 11, in some cases, the polishing member 11 is mounted to directly cover the elastic member 8. In this case, as shown in FIGS. 10 to 13, if the portion of the polishing member 11 side of the elastic member 8 is expanded gradually to be formed in a substantially bell shape, it is easy to mount the polishing member 11.

Figure 14:
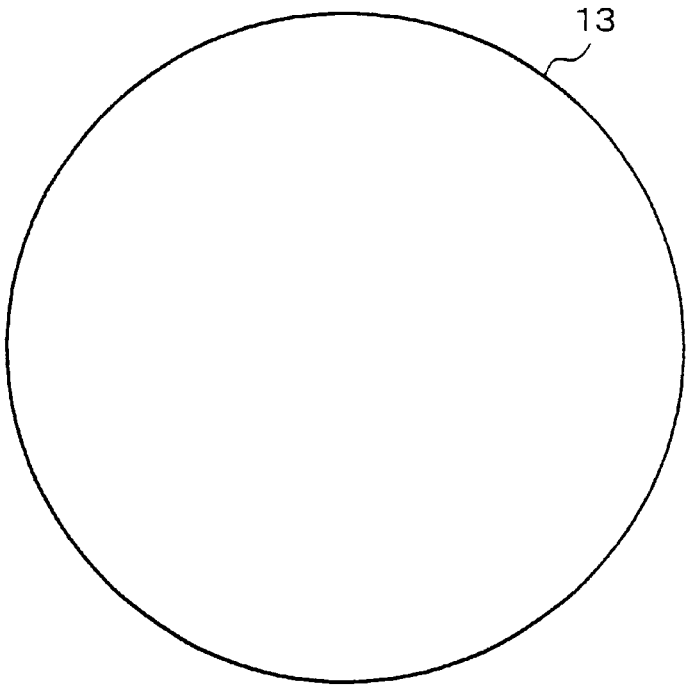
FIG. 14 is a plan view of a shock moderating member in accordance with the embodiment of the present invention.
Figure 15:
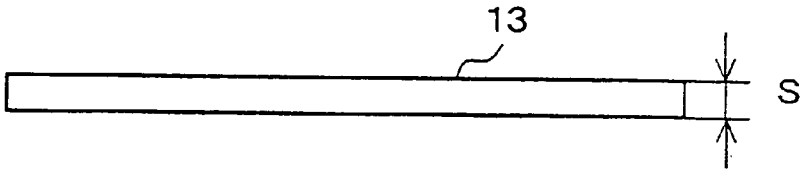
FIG. 15 is a side elevational view of the shock moderating member in accordance with the embodiment of the present invention.

A shock moderating member 13 (shock absorber) shown in FIGS. 14 and 15 is interposed between the base member 6 and the elastic member 8. The shock moderating member 13 is disk-shaped to be congruent with the base member 6 in the same manner as the elastic member 8 or the polishing member 11 with a thickness S being set in the range of 3 mm to 6 mm.

The method of using the polishing tool 1 having the above-described structure and the polishing process will now be described. Note that in the following description, as shown in FIG. 16, a type of a polishing tool 1 in which the elastic member 8, the polishing member 11 and the shock moderating member 13 are fixed to each other with adhesives, and this assembly is mounted on the base member 6 by the pad 12 subjected to the magic type process will now be described. Also, the elastic member 8 shown in FIGS. 4 and 5, the polishing member 11 shown in FIGS. 8 and 9 and the shock moderating member 13 shown in FIGS. 14 and 15 are used.

Figure 17:
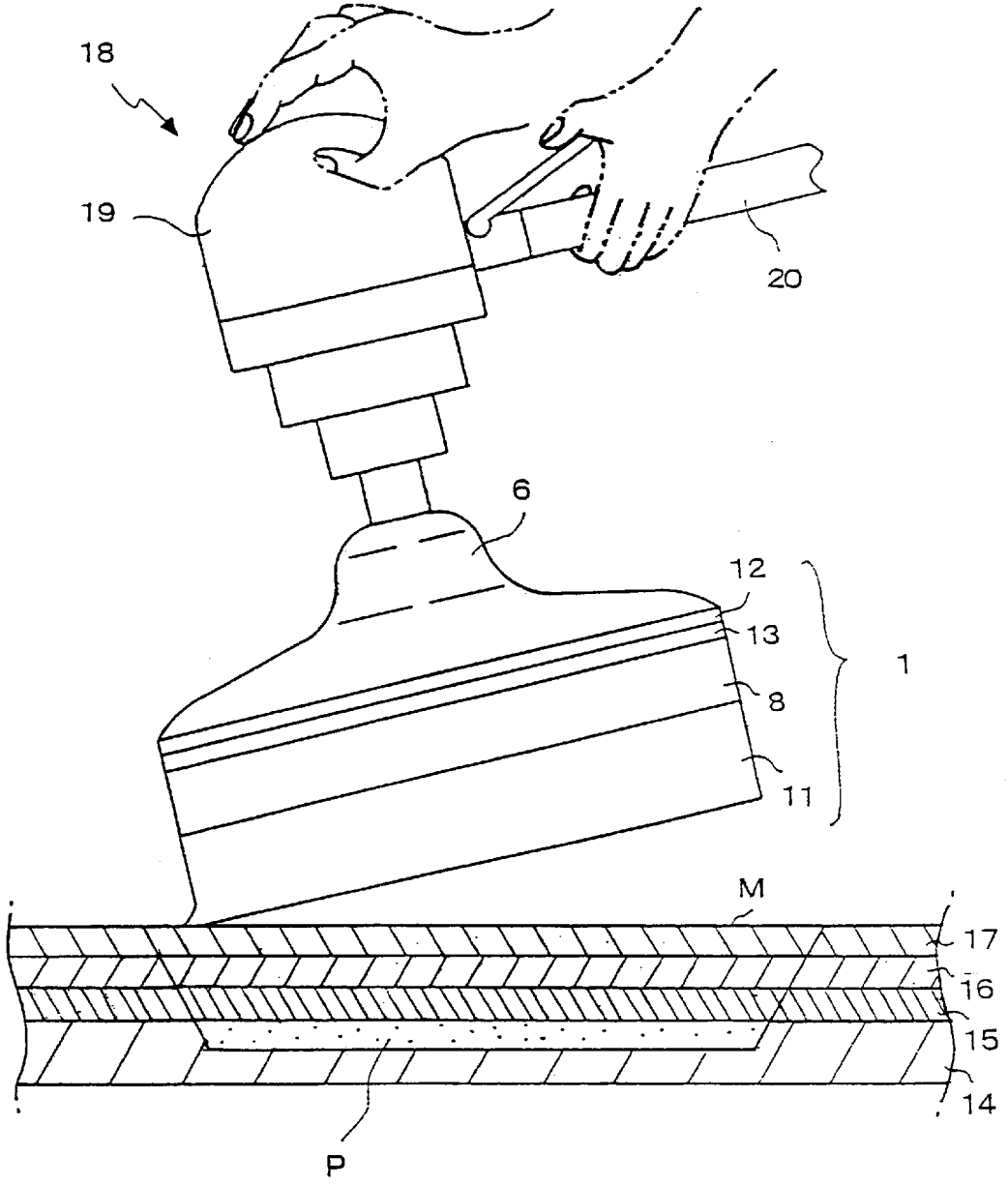
FIG. 17 is a view showing the initial operational condition of the polishing tool in accordance with the embodiment of the present invention.

A first of all, as shown in FIG. 17, the polisher 18 is operated such that a coating surface M in the final stage of the overcoating step (under the condition that the putty P is filled in the recess portion to be repaired on the steel plate 14 and the primer 15, the surfacer 16 and the paint 17 have been sprayed in this order to form a layer thereon) is brought into contact with the polishing member 11 adhered with the compound at an angle to some extent. The polisher 18 is composed of a drive unit 19 for drivingly rotating the polishing tool 1 and a grip 20 mounted on the drive unit 19 for operating the polisher.

Figure 18:
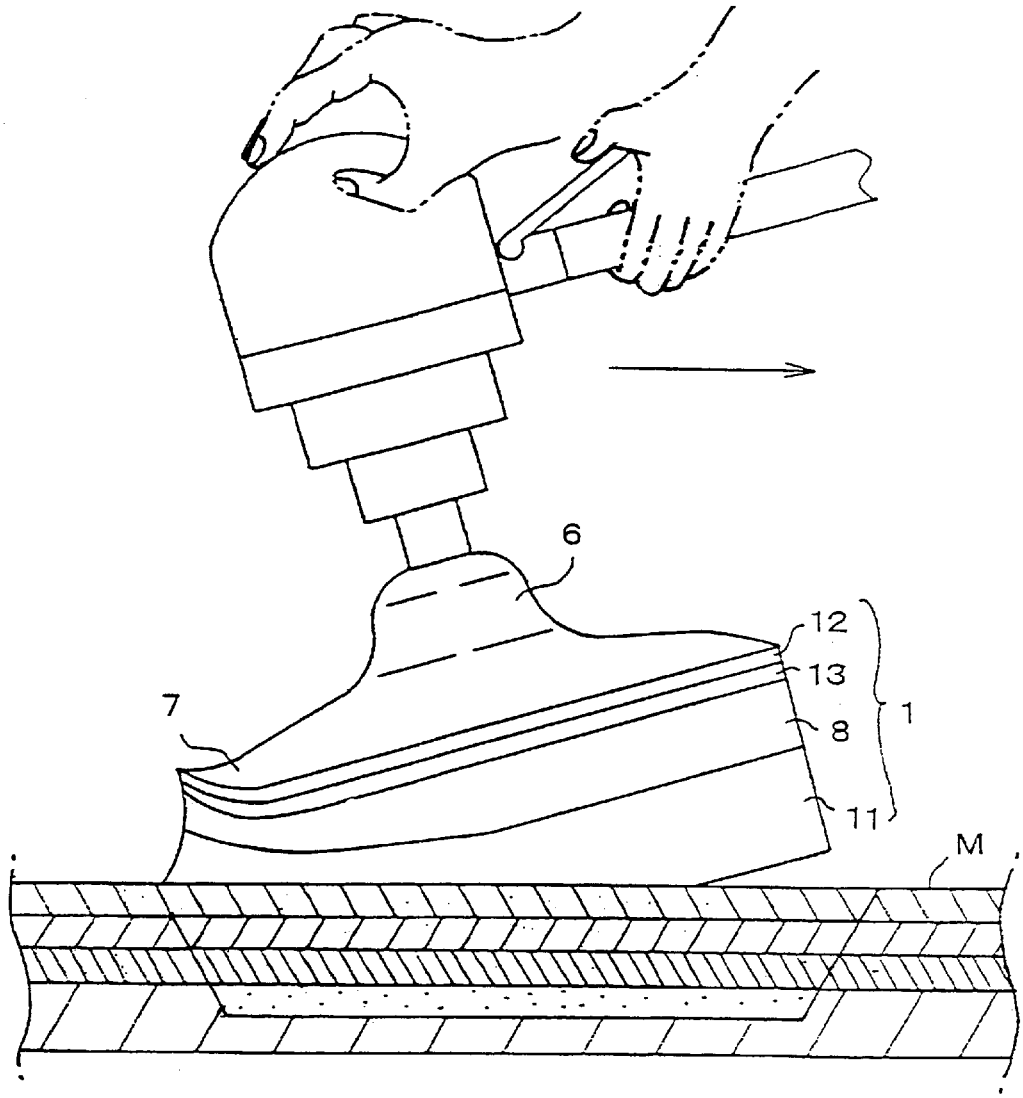
FIG. 18 is a view showing the operational condition of the polishing tool in accordance with the embodiment of the present invention.

As shown in FIG. 18, in the operating method, in the case where the polishing tool 1 rotates clockwise, the grip portion 20 is gripped by a left hand, the top portion of the drive unit 19 is gripped by a right hand and the polisher 18 is drawn forwardly so as to resist the rotation of the polishing tool 1. Incidentally, it is preferable to keep the torque of the polishing tool 1 constant in order to perform a stabler operation.

Then, the polishing member 11 is crashed to decrease its thickness by the force for depressing the polishing tool 1 against the coating surface M and the repulsive force from the coating surface M for the depressing force. In accordance with this, the elastic member 8, the shock moderating member 13 and the pad 12 overlapped on the polishing member 11 are also crashed to decrease the thickness. Furthermore, when the work is to be performed, since the polishing member 11 is depressed at an angle to some extent, the polishing member 11 is of course deformed considerably and the deformation of the circumferential edge portions of the elastic member 8, the shock moderating member 13 and the pad 12 becomes remarkable. Then, the circumferential edge portion 7 of the base member 6 is deformed in accordance with this deformation. As a result, it is possible to well cope with complicated shapes such as concave and convex portions of the coating surface M, and a corner portion or an edge portion that has been conventionally considered to be difficult to polish.

Figure 19:
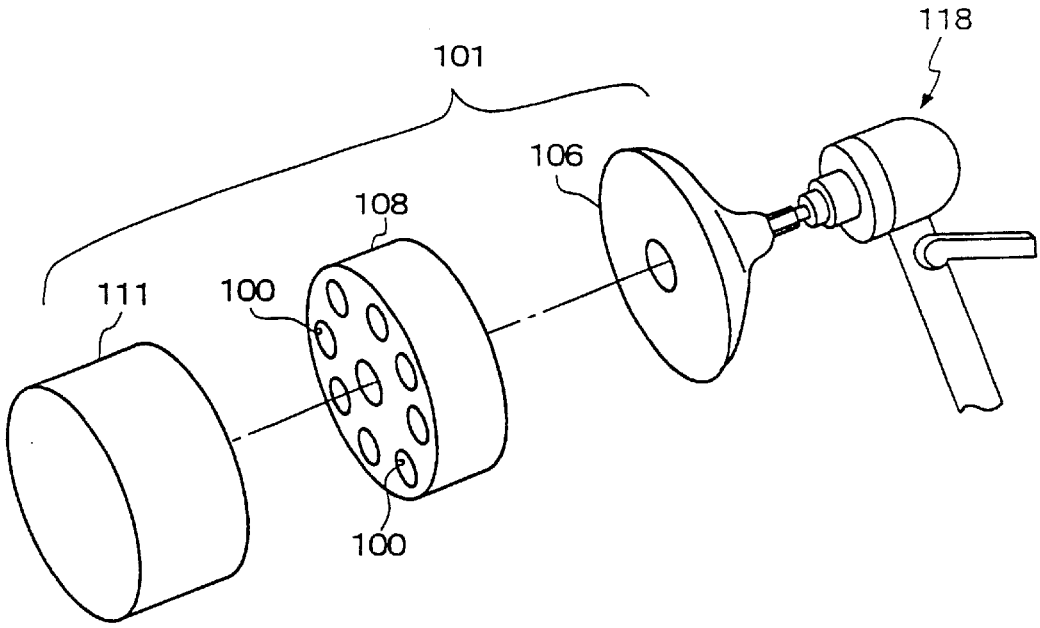
FIG. 19 is an exploded perspective view showing a conventional polishing tool.
Figure 20:
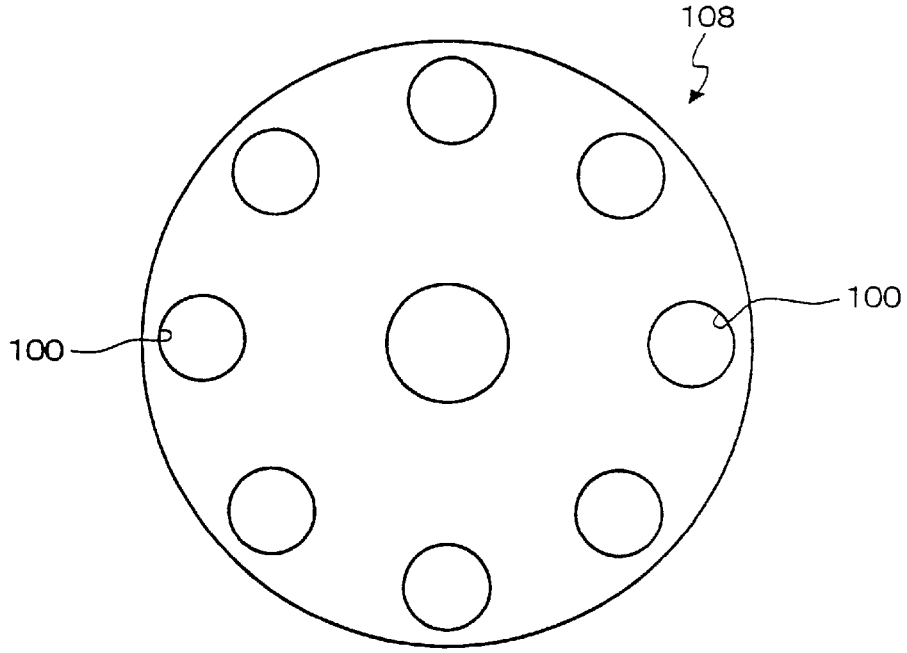
FIG. 20 is a plan view showing a conventional elastic member.
Figure 21:
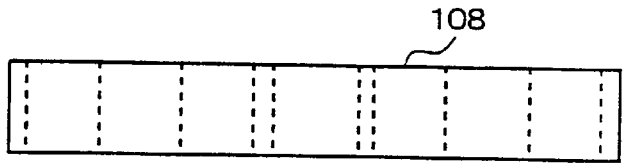
FIG. 21 is a side elevational view showing the conventional elastic member.

Furthermore, in the polishing tool 101 shown in FIG. 19, the bound phenomenon in which the centrifugal force working on the polishing member 11 at the moment the polishing member 11 is brought into contact with the polishing surface M is repulsive to the static coating surface M is generated, but in the polishing tool 1 according to this embodiment, this force is absorbed by the shock moderating member 13 interposed between the elastic member 8 and the base member 6 is absorbed to thereby make it possible to avoid the bound phenomenon. Also, as a result, it is possible to avoid a phenomenon such as resonant vibration or waving of the polishing tool 1.

Also, if the shock moderating member 13 is provided so as to work on the overall surface of the surface to be polished of the polishing member 11, the grinding effect and polishing effect are enhanced. Namely, it is possible to simultaneously perform the grinding and glossing works.

Also, if the cloth material, particularly, the wool (towel material) is used for the polishing member 11, it is possible to absorb to some suitable extent the frictional heat generated between the cloth material and the coating surface M in accordance with the rotational motion of the polishing member 11. The meaning of "to some suitable extent" is that a suitable frictional heat should be left. This is because some frictional heat is effective to grind the fine concave and convex of the coating surface M through the polishing member 11 and the coating surface M.

In addition to the above-described polishing member 11, the groove portions 9 having the linear portions on the opening edges 10 are provided to extend from the center of the elastic member 8 toward the circumferential edge, whereby it is possible to perform the two-stage polishing of the line and the surface. More specifically, first of all, the linear grinding is gradually performed in accordance with the operation of the polisher 18 as the linear portions of the opening edges 10 are brought into point contact with the convex portions scattered on the coating surface M. Thereafter, the glossing is performed by the surface where no groove portions 9 are provided. As a result, it is possible to repair the coating surface M smoothly.

Furthermore, the groove portions 9 are provided to extend in a linear manner from the center of the elastic member 8 toward the circumferential edge, whereby it is possible to facilitate the grinding and glossing works of the corner portion or the edge portion that has been difficult to work with the polishing tool 101 shown in FIG. 19. This is because the hard material having the elasticity is used for the elastic member 8 and the softer material than that of the elastic member 8 is used for the polishing member 11. For this reason, it becomes easy to transfer the complicated shape like the corner portion or the edge portion through the polishing member 11 to the elastic member 8.

Moreover, since the groove portions 9 extend radially from the center of the elastic member 8 to the vicinity of the circumferential edge thereof, it is possible to grind the large amount of convex and concave portions at once through the polishing member 11. Then, the working time is shortened by simultaneously performing both grinding and glossing works in the wider range, thereby enhancing the working efficiency.

Also, the width of the grooves of each groove portion 9 is adapted to be increased from the center of the elastic member 8 to the circumferential edge. For this reason, the ground contact area at the center of the polishing member 11 interposed between the elastic member 8 and the coating surface M is balanced with the ground contact area of the circumferential edge to thereby make it possible to grind and gloss the coating surface M without nonuniformity. Namely, it is possible to dispense with the highly technical skill that is required for the operator or the feeling or the like that would be obtained through the experience. It is therefore possible for the non-experienced people to work with a relatively high efficiency. Also, since the contact areas in the vicinity of the center of the polishing member 11 and the circumferential edge of the polishing member 11 may be kept substantially constant, it is possible to prevent the local excessive frictional wear of the polishing member 11.

Furthermore, as shown in FIG. 2, the circumferential edge of the base member 6 is formed to be movable. Since the movable angle e of the circumferential edge (hereinafter referred to as a flap angle) is in the range of about 0 to 60, the shape of the corner portion or the edge portion is well transmitted from the polishing member 11 brought into direct contact with the coating surface M, and it is possible to move the circumferential edge in correspondence therewith. Also, in view of the fact that the above-described groove portions 9 are formed with the width thereof being increased from the center of the elastic member 8 toward the circumferential edge, it is possible to further enhance the movability of the circumferential edge portion 7.

Incidentally, in order to facilitate the circumferential edge portion 7 of the base member 6 to be movable, it is possible to take a structure in which a thickness of the circumferential edge portion 7 is thinned in comparison with that of the convex portion 5, a softer material toward the circumferential edge portion 7 from the center of the convex portion 5 is used, a more elastic material is used for the material per se of the base portion, or a spring or the like is built in the circumferential edge portion 7.

The polishing tool according to the present invention is suitable particularly as a polishing tool for polishing a coating surface of a vehicle into a predetermined shape. Also, the polishing tool according to the present invention is applied not only to the vehicle but also to any other use such as polishing of a coating surface of furniture or the like or polishing a wall surface of a building.

What is claimed is:

1. A polishing tool comprising:

a base member adapted to be attached to and drivingly rotated by a drive unit and having a mounting surface perpendicular to its rotary axis;

an elastic member attached to the base member; and a polishing member attached to the elastic member, wherein the elastic member has groove portions opened toward the polishing member side and extending from a center of the elastic member toward a circumferential edge thereof, and the opening edges of the grooves portions are linear from the center of the elastic member to the circumferential edge thereof, wherein the diameters of the base member, the elastic member, and the polishing member are substantially the same, and the circumferential edges thereof are substantially aligned, wherein said base member is flexible, and its circumferential edge is more flexible than its center.

2. A polishing tool according to claim 1, wherein the groove portions are formed so that their width is increased from the center of the elastic member toward the circumferential edge thereof.

3. A polishing tool according to claim 1 or 2, wherein the groove portions are provided extending radially from the center of the elastic member.

4. A polishing tool according to claim 1, wherein the circumferential edge of the base member is formed to be movable relative to the center of the base member.

5. A polishing tool according to claim 4, wherein the base member is formed so that the thickness thereof decreases from the center to the circumferential edge.

6. A polishing tool according to claim 4 or 5, wherein the base member is formed by using a softer material toward the circumferential edge than at the center so that the flexibility of the base member is enhanced from the center toward the circumferential edge.

7. A polishing tool according to claim 1, wherein the polishing member is formed of a material softer than that of the elastic member.

8. A polishing tool according to any one of claims 1, 2, 4, 5, and 7, wherein a shock moderating member is disposed between the base member and the elastic member.

* * * * *